United States Patent [19]

Ostergard

[11] Patent Number: 4,767,118

[45] Date of Patent: Aug. 30, 1988

[54] ANKLE EXERCISING DEVICE

[76] Inventor: Doak Ostergard, Apartment 5, 1842 Knox, Lincoln, Nebr. 68521

[21] Appl. No.: 850,969

[22] Filed: Apr. 11, 1986

[51] Int. Cl.[4] ..... A63B 23/04

[52] U.S. Cl. ..... 272/96; 272/116; 272/71; 441/60

[58] Field of Search ..... 272/71, 93, 96, 116, 272/119, 130, 143, 1 B; 441/60–64

[56] References Cited

U.S. PATENT DOCUMENTS

| | | | |
|---|---|---|---|
| 3,517,930 | 6/1970 | Jacobsen | 272/71 |
| 3,952,351 | 4/1976 | Gisbert | 441/60 |
| 4,017,925 | 4/1977 | Shamlian | 441/64 |
| 4,337,939 | 7/1982 | Hoyle et al. | 272/96 |
| 4,411,422 | 10/1983 | Solloway | 272/96 |
| 4,509,744 | 4/1985 | Beasley | 272/116 |
| 4,521,011 | 6/1985 | Solloway | 272/116 |
| 4,632,387 | 12/1986 | Guzman | 272/116 |

*Primary Examiner*—Richard J. Apley
*Assistant Examiner*—Robert H. Bahr
*Attorney, Agent, or Firm*—Zarley, McKee, Thomte, Voorhees & Sease

[57] ABSTRACT

An ankle exercising device designed for use in a whirlpool or hydrotherapy bath comprises a foot receiving and attachment portion having a movement resistance member secured thereto. The movement of the device through the water in an upward, downward, or sideways manner is resisted by the movement resistance member.

3 Claims, 2 Drawing Sheets

ANKLE EXERCISING DEVICE

BACKGROUND OF THE INVENTION

This invention relates to an ankle exercising device and more particularly to an ankle exercising device which may be used in a hydrotherapy tub which is commonly referred to as a whirlpool tub or whirlpool.

It has been found that an injured ankle will be rehabilitated much more quickly if the ankle is immersed in a whirlpool tub. It has been found that the injured ankle will be rehabilitated even more quickly if the ankle is exercised in the hot water against a yieldable resistance.

Many types of ankle exercising devices have been previously provided for use in rehabilitating injured ankles. Some of the prior art devices are not suitable for use in a whirlpool tub although the immersion of the injured ankle in a whirlpool tub has been found to be therapeutic. Those prior art ankle exercising devices, which are capable of being immersed in water, do not provide the desired resistance to movement in upwardly, downward and sideways directions.

It is therefore a principal object of the invention to provide an improved ankle exercising device.

A further object of the invention is to provide an improved ankle exercising device which may be immersed in a whirlpool tub or the like.

Another object of the invention is to provide an improved ankle exercising device which may be immersed in water and which offers resistance to movement of the ankle in an upward, downward or sideways direction.

Yet another object of the invention is to provide an improved ankle exercising device which may be quickly and easily secured to a person's foot.

Still another object of the invention is to provide an improved ankle exercising device which is economical of manufacture, durable in use and refined in appearance.

SUMMARY OF THE INVENTION

An ankle exercising device is described which may be quickly and easily secured to a person's foot with the device then being immersed in a whirlpool tub or the like. The device comprises a foot-receiving portion which is secured to the person's foot and which has a movement resistant means secured thereto. The movement resistant means comprises a flat plate having upstanding walls at the forward and side edges thereof so that movement of the ankle in the water will be resisted thereby. The movement resistance means offers yieldable resistance to movement in upward and downward directions. When the movement resistance means is rotated 90° from the position just described, the movement resistance means offers resistance to movement in sideways directions.

DESCRIPTION OF THE PREFERRED EMBODIMENT

Figure 1:
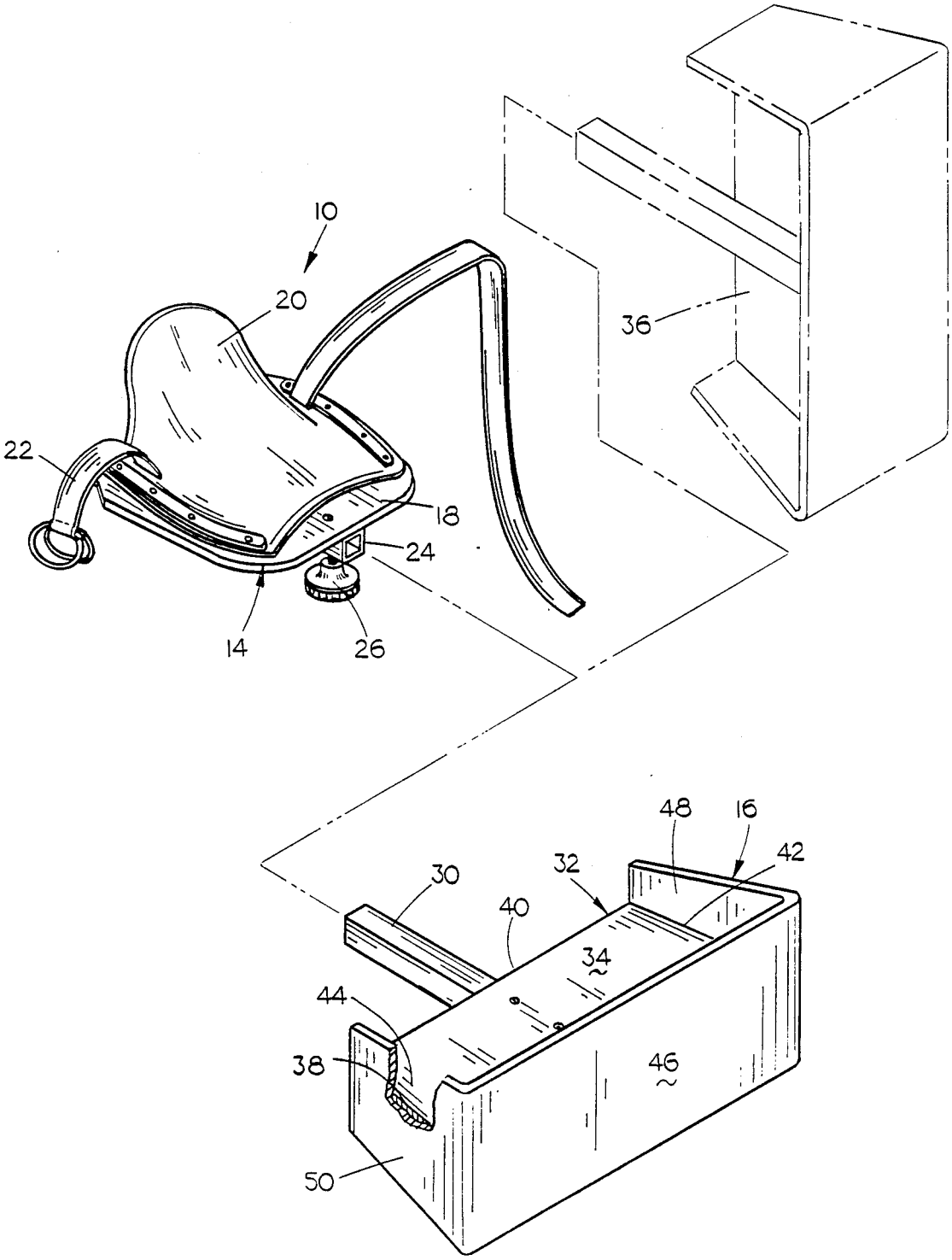
FIG. 1 is an exploded perspective view of the device of this invention with the broken lines indicating the alternate position of the movement resistant means.

The ankle exercising device of this invention is referred to generally by the reference numeral 10 while the numeral 12 will be used to designate the foot of the person using the device.

Device 10 generally comprises a support means 14 having a movement resistance means 16 removably secured thereto. Support means 14 is adapted to receive the foot 12 as seen in the drawings and includes a base plate 18 having a foot receiving portion 20 positioned thereon. When the person's foot is received in the receiving portion 20, strap means 22 is extended around the foot and secured as illustrated. Tube 24 is mounted on the bottom of base plate 18 and has a screw 26 mounted thereon.

Elongated member 30 of movement resistance means 16 is removably mounted in tube 24 and maintained therein by the screw 26. Elongated member 30 extends forwardly from tube 24 and has a flat plate 32 mounted thereon by any convenient means. For purposes of description, plate 32 will be described as having upper surfaces 34, bottom surface 36, forward edge 38, rearward edge 40, and opposite side edges 42 and 44.

A forward end wall 46 is secured to the forward edge 38 of plate 32 and normally extends upwardly and downwardly therefrom. Side walls 48 and 50 are secured to side edges 42 and 44 respectively and also normally extend upwardly and downwardly therefrom as seen in the drawings. It is also preferred that the side walls 48 and 50 extend inwardly and rearwardly.

Figure 2:
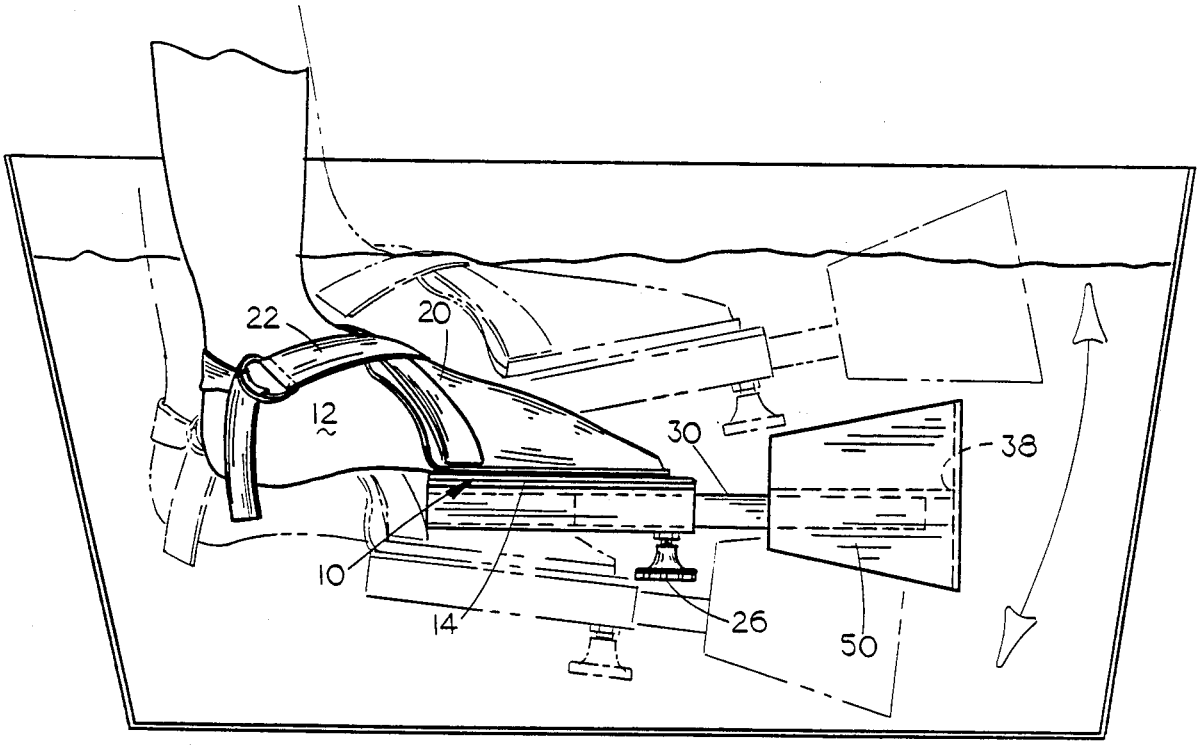
FIG. 2 is a side view illustrating the device mounted on a person's foot with the device being moved upwardly and downwardly.

When it is desired to exercise the person's ankle in a whirlpool bath, the person's foot is inserted into the foot receiving portion 20 and the strap means 22 is secured around the person's ankle. If elongated member 30 was not previously mounted in tube 24, it is inserted at this time so that the plate 32 is parallel to base plate 18. Screw 26 is then tightened. The person's leg is then inserted into the whirlpool bath. The leg and the ankle of the person are then successively moved upwardly and downwardly in the water as illustrated in FIG. 2. When the device is moved upwardly, the water impinges on the upper surface 34 of plate 32 and is yieldably held thereon by the walls 46, 48 and 50 so that yieldable resistance is offered to such upward movement. Lowering or downward movement of the foot is also resisted by the water due to impingement of the water on the bottom surface 36 of plate 32. The walls 46, 48 and 50 prevent the water from easily passing from the plate 32.

Figure 3:
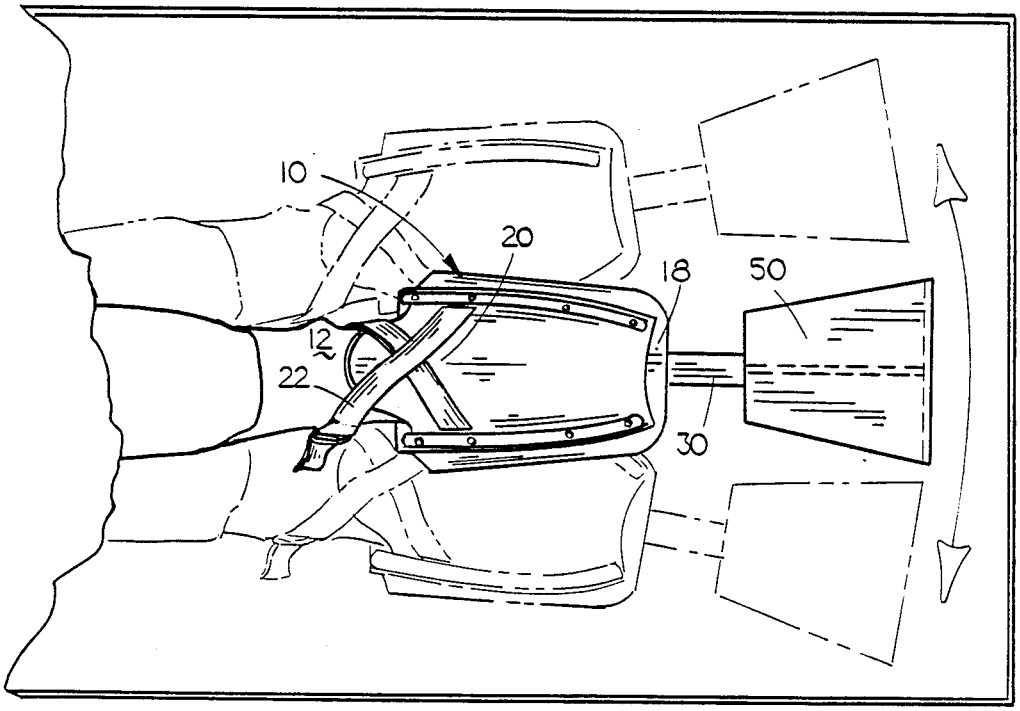
FIG. 3 is a top view illustrating the device mounted on a person's foot and being moved in a sideways manner.

The device may also be used to exercise the ankle in a "sideways" manner by rotating the elongated member 90° in tube 24 so that plate 32 dwells in a vertical plane as seen in Figure 3. Such an orientation provides resistance to reciprocal sideways movement of the ankle and foot.

Elongated member 30 is selectively longitudinally received by the tube 24 to enable the movement resistance means to be spaced or positioned from the support means 14 as desired to increase or decrease the resistance offered by the movement resistance means.

Thus it can be seen that a novel ankle exercising device has been provided for use in a whirlpool bath or the like which may be utilized to offer resistance to upward, downward and sideways movement of the ankle to strengthen the ankle.

It can therefore be seen that the invention accomplishes at least all of its stated objectives.

I claim:

1. An ankle exercising device for use in water, comprising, a support means adapted to be removably secured to a person's foot, said support means having rearward and forward ends, a movement resistance means secured to said support means positioned forwardly of the forward end of said support means for resisting the movement of the person's foot when the foot is immersed in water, said movement resistance means comprising a plate having top and bottom surfaces, rearward and forward edges, and opposite side edges, and upstanding wall means secured generally transversely and substantially from side edge to side edge on said plate, an elongated member secured to said support means and extending forwardly therefrom, said movement resistance means being secured to the forward end of said elongated member.

2. An ankle exercising device for use in water, comprising, a support means adapted to be removably secured to a person's foot, said support means having rearward and forward ends, said support means comprising a flat base plate having a foot receiving portion positioned thereon, and a strap means for securing the support means to the person's foot, a movement resistance means secured to said support means positioned forwardly of the forward end of said support means for resisting the movement of the person's foot when the foot is immersed in water, an elongated member removably secured to said base plate and extending forwardly therefrom, said movement resistance means being secured to the forward end of said elongated member, said elongated member being selectively rotated 90° with respect to said base plate, said movement resistance means comprising a plate means having top and bottom surfaces, rearward and forward edges, and opposite side edges.

3. An ankle exercising device for use in water, comprising, a support means adapted to be removably secured to a person's foot, said support means having rearward and forward ends, a movement resistance means secured to said support means positioned forwardly of the forward end of said support means for resisting the movement of the person's foot when the foot is immersed in water, said movement resistance means comprising a plate means having top and bottom surfaces, rearward and forward edges, and opposite side edges, said plate means having upstanding wall means secured thereto, and said movement resistance means being selectively adjustably secured to said support means to enable the selective spacing of said movement resistance means with respect to said support means.

* * * * *